US005667259A

United States Patent [19]

Torkowski

[11] Patent Number: 5,667,259

[45] Date of Patent: Sep. 16, 1997

[54] POWER ACTUATOR FOR CHILD-SAFETY MOTOR-VEHICLE DOOR LATCH

[75] Inventor: Thorsten Torkowski, Herne, Germany

[73] Assignee: Kiekert AG, Heiligenhaus, Germany

[21] Appl. No.: 523,747

[22] Filed: Sep. 5, 1995

[30] Foreign Application Priority Data

Sep. 15, 1994 [DE] Germany ..... 44 32 799.4

[51] Int. Cl.[6] ..... E05C 3/06

[52] U.S. Cl. ..... 292/201; 292/DIG. 23

[58] Field of Search ..... 292/201, DIG. 27, 292/DIG. 23

[56] References Cited

U.S. PATENT DOCUMENTS

| | | | |
|---|---|---|---|
| 4,900,074 | 2/1990 | Kleefeldt et al. | 292/216 |
| 5,240,296 | 8/1993 | Kobayashi | 292/201 |
| 5,261,711 | 11/1993 | Mizuki et al. | 292/201 |
| 5,476,294 | 12/1995 | Menke | 292/201 X |

*Primary Examiner*—Rodney M. Lindsey
*Attorney, Agent, or Firm*—Herbert Dubno; Andrew Wilford

[57] ABSTRACT

A motor-vehicle door latch has an operating lever and is provided with a child-safety cutout device movable between an enabled position in an on position of the operating lever and a disabled position in an angularly offset off position of the lever. A power actuator for the latch has a housing immediately adjacent the operating lever, an electric motor on the housing, and a rotatable output wheel on the housing adjacent the operating lever. A gear train on the housing connects the motor to the wheel for rotation of the wheel by the motor and a coupling lever fixed on and rotatable with the wheel has a pin that fits in a slot formed on the operating lever so that rotation of the wheel pivots the lever between its positions. A switching wheel or disk in the housing coaxial with and adjacent the output wheel is connected via a lost-motion coupling to the output wheel for rotating the switching wheel by the output wheel only after travel of the output wheel through a predetermined angular play. A switch in the housing operable by the switching wheel on rotation thereof signals the position of the operating lever.

3 Claims, 2 Drawing Sheets

POWER ACTUATOR FOR CHILD-SAFETY MOTOR-VEHICLE DOOR LATCH

FIELD OF THE INVENTION

The present invention relates to a child-safety motor-vehicle door latch. More particularly this invention concerns a power actuator for such a latch.

BACKGROUND OF THE INVENTION

As described in commonly owned U.S. Pat. Nos. 4,900,074 and 5,476,294, a motor-vehicle door latch normally has a housing, a pivotal lock fork on the housing engageable with a door bolt and pivotal between a locked position engaged around the bolt and retaining it on the housing and an unlocked position permitting the door bolt to move into and out of the housing, a release pawl engageable with the fork and displaceable between a holding position retaining the fork in the locked position and a freeing position out of engagement with the fork and permitting the fork to move into the unlocked position, and a lever mechanism connected to the release pawl and movable between an actuated position displacing the pawl into the freeing position and an unactuated position with the pawl in the holding position Inside and outside handles operable from inside and outside the vehicle are connected to the lever mechanism to operate it and unlatch the door. Inside and outside lock elements are also connected to this mechanism to prevent at least the outside handle from operating the lever mechanism.

To prevent a door, normally a rear-seat door, from being accidentally opened, normally by a child, it has become standard to provide a so-called child-safety or -cutout system. This is typically embodied as an element that is exposed at the edge of the door when the door is open and that can be moved manually between an on and off position. In the on position the inside door handle is no longer operational.

Such a mechanism works in either of two ways: It can simply block actuation of the inside handle by putting some element in the movement path. Thus the inside handle cannot be moved at all. Alternately it can decouple the inside handle from the latch mechanism so that, even though the inside handle can be actuated, such actuation will have no effect.

The problem with this arrangement is that the vehicle operator frequently forgets to enable or disable the child-safety feature, leaving it off when children are being transported or leaving it on so adult passengers have to be let out of the back seat. The fact that the latches must be individually and manually set is the main reason this feature is not used more, and attempts to operate it via a power-lock system or the like have not proven practical or inexpensive enough to warrant broad use.

OBJECTS OF THE INVENTION

It is therefore an object of the present invention to provide an improved child-safety motor-vehicle door latch.

Another object is the provision of such an improved child-safety motor-vehicle door latch which overcomes the above-given disadvantages, that is which can be remotely operated.

SUMMARY OF THE INVENTION

The instant invention is used in combination with a motor-vehicle door latch having an operating lever and provided with a child-safety cutout device movable between an enabled position in an on position of the operating lever and a disabled position in an angularly offset off position of the lever. The invention is a power actuator having a housing immediately adjacent the operating lever, an electric motor on the housing, and a rotatable output wheel on the housing adjacent the operating lever. A gear train on the housing connects the motor to the wheel for rotation of the wheel by the motor and a coupling lever fixed on and rotatable with the wheel has a pin that fits in a slot formed on the operating lever so that rotation of the wheel pivots the lever between its positions. A switching wheel or disk in the housing coaxial with and adjacent the output wheel is connected via a lost-motion coupling to the output wheel for rotating the switching wheel by the output wheel only after travel of the output wheel through a predetermined angular play. A switch in the housing operable by the switching wheel on rotation thereof signals the position of the operating lever.

The invention is based on the recognition that, in a motor-vehicle door latch with child-safety mechanism, the child-safety lever is arranged such that it is particularly easy to provide an electrical-motor drive linkage for it which can be very compact. The parts of the drive can be easily mass produced and can be either built right into the latch or mounted on it. In this simple manner it is possible to provide an effective and inexpensive actuator for the child-protection system.

According to the invention one of the wheels is provided with an axially extending arm and the other wheel is formed with an arcuately elongated slot receiving the arm with play and forming with the arm the lost-motion coupling. The coupling lever has an inner end with a pin extending along the axis and set in the output wheel.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
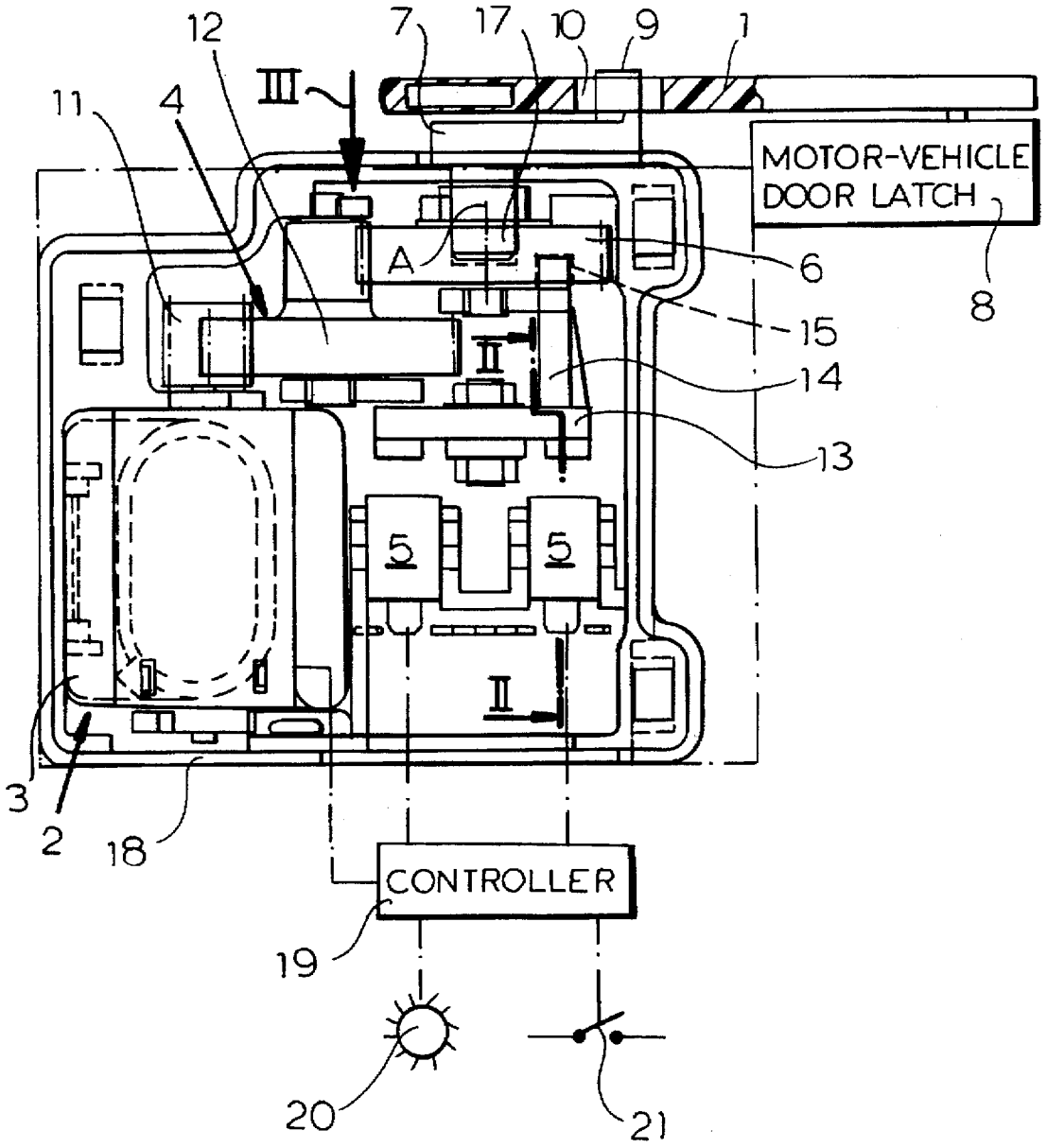
FIG. 1 is a partly sectional and diagrammatic top view of a power actuator and door latch according to the invention.
Figure 3:
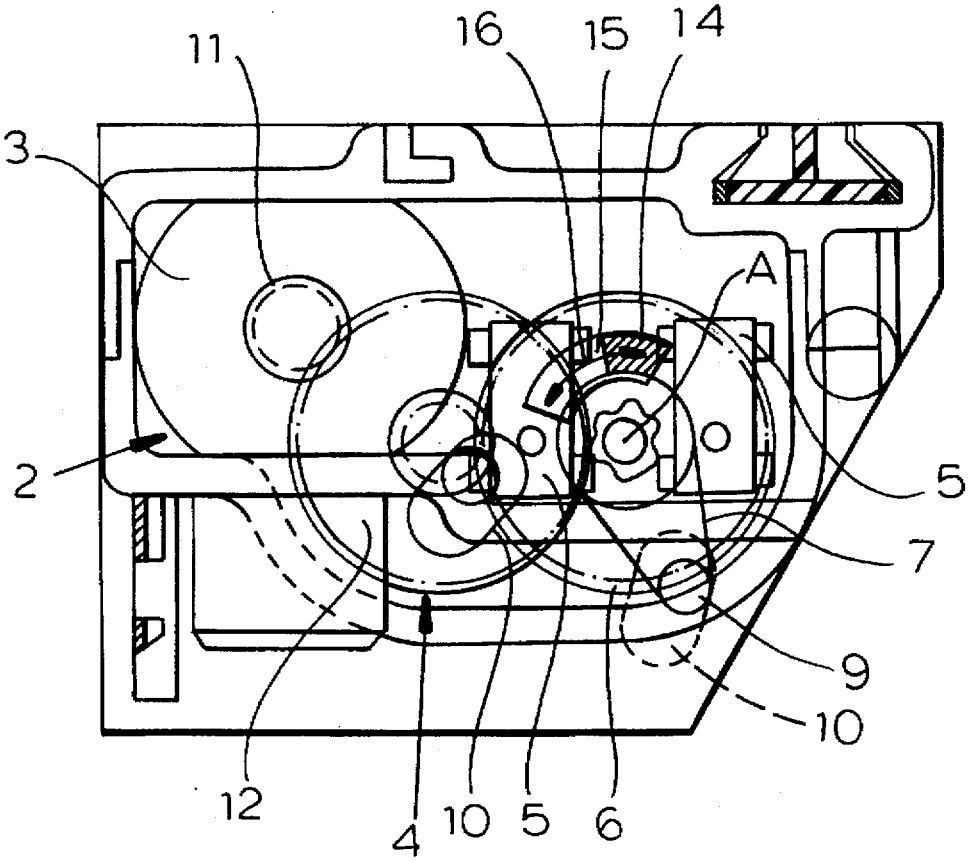
FIG. 3 is a side partly sectional view taken in the direction of arrow III of FIG. 1.

As seen in FIGS. 1 and 3 a motor-vehicle door latch 8 as described in the above-cited patent reference has a child-safety operating lever 1 that can be pivoted between a position enabling the child-safety feature, that is disconnecting the inside door handle, and a position disabling this feature. According to the invention a power-actuator housing 18 is mounted adjacent or on the latch 8 and contains a drive 2 comprising an electric motor 3 working through a gear train 4 comprised of an input gear 11 mounted on the motor shaft, an intermediate gear 12, and an output gear 6 pivotal about an axis A. A coupling lever 7 has an input pin 17 seated and fixed in the gear wheel 6 at the axis A and an output pin 9 fitted in a slot 10 formed in the lever 1.

A switching disk 13 pivotal about the axis A in the housing 18 has an entrainment arm 14 extending toward the wheel 6 and fitted in an arcuately elongated slot 15 therein where it is received with angular play 16. This disk 13 has an opposite side formed with a camping bump 13' engageable with actuating buttons 5' of switches 5 connected to an indicator/control system 19 that is also connected to the motor 3 and to various indicator lamps 20 and a switch 21 for controlling the motor 3 and indicating the condition of the device.

Figure 2:
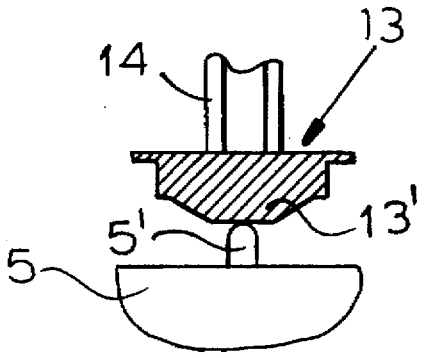
FIG. 2 is a section taken along line II—II of FIG. 1.

Thus actuation of the switch 21 will start the motor 3 to rotate the wheel 6 via the gear train 4 and thereby also rotate the lever 7. The pin 9 in the slot 10 will thus pivot the operating lever 1 from the off to the on position. At the same time the wheel 6 will rotate through its play 16 and entrain the wheel 13 which is constructed to move the bump 13' past the switches 5, thereby actuating one of them so as to light the lamp 20 when the lever 1 is wholly in the child-safety on position as shown in FIG. 2. Such power actuators are normally provided on both back doors and are normally connected in parallel for joint operation.

Subsequent actuation of the switch 21 will reverse rotate the motor 3 which will first move the operating lever 1 back into the off position and, once the play 16 is again overcome, will rotate back the disk 13 and actuate the other switch 5, thereby extinguishing the lamp 20.

I claim:

1. In combination with a motor-vehicle door latch having an operating lever and provided with a child-safety cutout device movable between an enabled position in an on position of the operating lever and a disabled position in an angularly offset off position of the lever, an inside door handle of the latch being disabled in the enabled position of the device, a power actuator comprising:

a housing immediately adjacent the operating lever;

an electric motor on the housing;

a rotatable output wheel on the housing adjacent the operating lever;

a gear train on the housing connecting the motor to the wheel for rotation of the wheel by the motor;

a coupling lever fixed on and rotatable with the wheel and having a pin, the operating lever being formed with a slot receiving the pin, whereby rotation of the wheel pivots the lever between its positions;

a switching wheel in the housing coaxial with and adjacent the output wheel;

a lost-motion coupling between the output wheel and the switching wheel for rotating the switching wheel by means of the output wheel only after travel of the output wheel through a predetermined angular play; and at least one switch in the housing operable by the switching wheel on rotation thereof.

2. The child-safety power actuator defined in claim 1 wherein one of the wheels is provided with an axially extending arm and the other wheel is formed with an arcuately elongated slot receiving the arm with play and forming with the arm the lost-motion coupling.

3. The child-safety power actuator defined in claim 1 wherein the coupling lever has an inner end with a pin extending along the axis and set in the output wheel.

* * * * *